US005582464A

United States Patent [19]

Maymon

[11] Patent Number: 5,582,464

[45] Date of Patent: Dec. 10, 1996

[54] CHAIR PRIMARILY FOR USE BY PERSONS WITH SPINAL CHORD INJURY

[76] Inventor: Herzel Maymon, 6264 Sunnycrest Dr., Agoura, Calif. 91301

[21] Appl. No.: 373,005

[22] Filed: Jan. 17, 1995

[51] Int. Cl.[6] ..... A47C 31/00

[52] U.S. Cl. ..... 297/487; 297/173; 297/338; 297/358; 297/393; 297/408; 297/423.26; 297/452.34

[58] Field of Search ..... 297/411.38, 411.36, 297/411.35, 411.27, 411.2, 487, 148, 173, 174, 344.18, 354.12, 353, 354.1, 284.3, 423.26, 188, 393, 358, 408, 410, 452.34, DIG. 6

[56] References Cited

U.S. PATENT DOCUMENTS

| | | | |
|---|---|---|---|
| 259,504 | 6/1882 | Cushing | 297/423.26 X |
| 461,928 | 10/1891 | White | 297/344.18 X |
| 712,743 | 11/1902 | Van Slyke | 297/423.35 X |
| 805,074 | 11/1905 | Kemp | 297/173 |
| 818,917 | 4/1906 | Ruger | 297/173 |
| 1,516,811 | 11/1924 | Edwards | 297/284.3 |
| 1,615,615 | 1/1927 | Cannon et al. . | |
| 2,690,208 | 9/1954 | Mary . | |
| 3,375,040 | 3/1968 | Hamilton et al. | 297/452.33 |
| 3,874,476 | 4/1975 | Monaghan | 297/488 X |
| 4,509,793 | 4/1985 | Weismann et al. . | |
| 4,521,053 | 6/1985 | de Boer . | |
| 4,641,884 | 2/1987 | Miyashita et al. | 297/284.3 X |
| 4,647,066 | 3/1987 | Walton . | |
| 4,765,684 | 8/1988 | Kvalheim et al. . | |
| 4,793,655 | 12/1988 | Kvalheim . | |
| 5,029,941 | 7/1991 | Twisselmann | 297/411.38 |
| 5,054,852 | 10/1991 | Tholkes . | |
| 5,062,676 | 11/1991 | Mars . | |
| 5,110,121 | 5/1992 | Foster . | |
| 5,143,422 | 9/1992 | Althofer et al. | 297/411.38 X |
| 5,242,180 | 9/1993 | Bergeron | 297/488 X |
| 5,275,465 | 1/1994 | Gulliver et al. | 297/173 |
| 5,378,042 | 1/1995 | Daneshvar | 297/393 |

FOREIGN PATENT DOCUMENTS

| | | | |
|---|---|---|---|
| 2318056 | 2/1977 | France | 297/488 |

*Primary Examiner*—Milton Nelson, Jr.
*Attorney, Agent, or Firm*—Poms, Smith, Lande & Rose

[57] ABSTRACT

A chair primarily for use by persons with spinal chord injury, comprises a universally positioned chair back and a universally positioned front support. Users sit upright and are held between the chair back and front support. Both the chair back and front support have sides to prevent users from falling to their sides. A tray also may be attached to the front support. The seating surface also adjusts vertically to the base and floor. Articulating arms attach the chair back and front support to other chair parts. The arms allow easy vertical, horizontal and angular movement of the chair back and front support, and the arms can be locked to secure the back and support.

20 Claims, 4 Drawing Sheets

FIG. 7
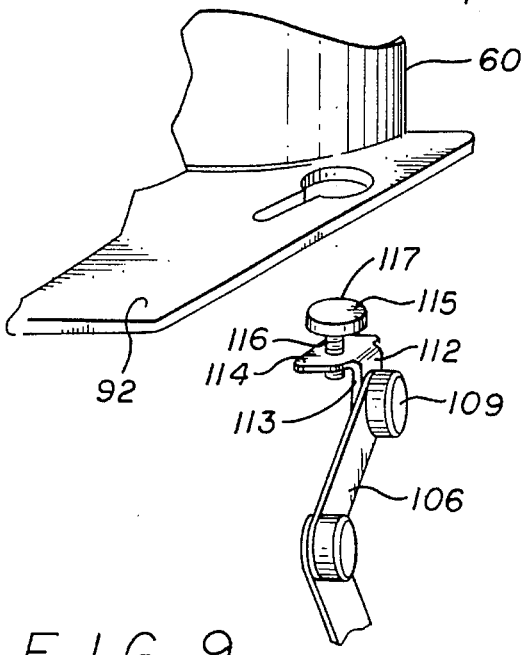
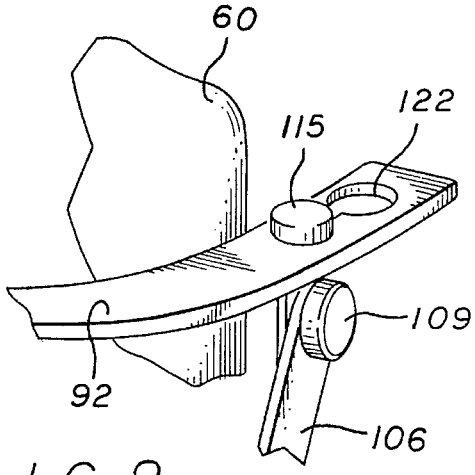
FIG. 8
FIG. 9
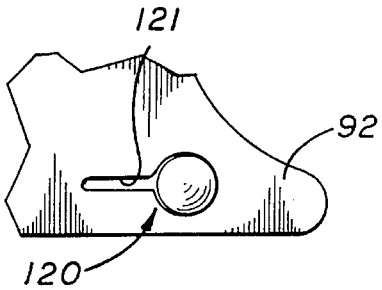
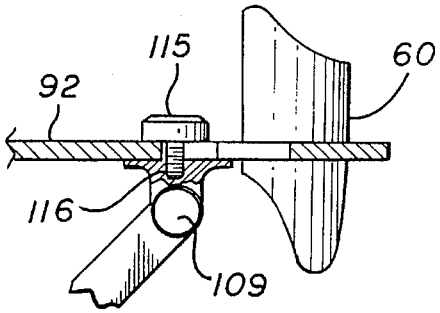
FIG. 11
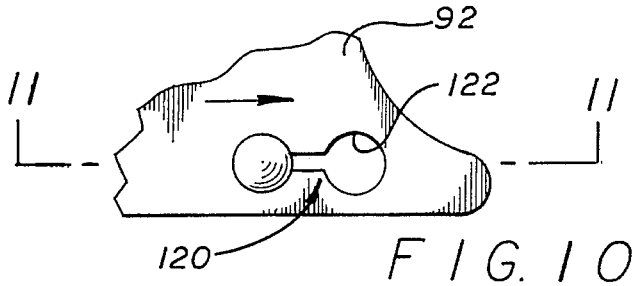
FIG. 10
FIG. 12
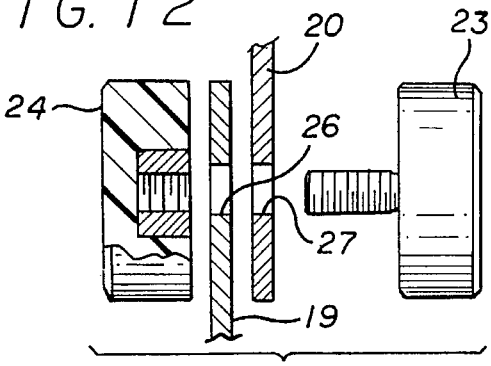
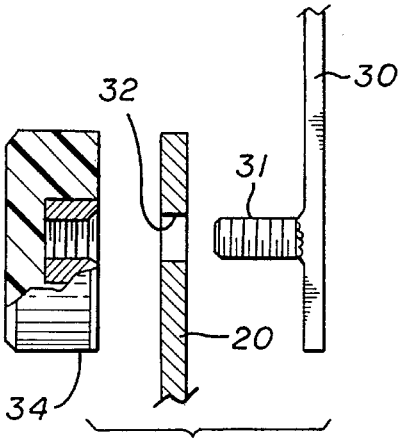
FIG. 13

CHAIR PRIMARILY FOR USE BY PERSONS WITH SPINAL CHORD INJURY

BACKGROUND OF THE INVENTION

1. Field of the Invention

The present invention relates to an adjustable chair primarily for paraplegics and quadriplegics in which many elements of the chair can be adjusted to suit the user.

2. State of the Art

The prior art teaches many adjustable chairs. For example, Walton, U.S. Pat. No. 4,547,055 (1987) teaches a chair with vertically adjustable seat and back portions. Kvalheim, U.S. Pat. No. 4,755,584 (1988) reaches a pivoting foot rest for a chair. Tholkes U.S. Pat. No. 5,054,852 (1991) has a chair and tray. An adjustable leg pad moves toward and away from the person's knees. The tray is not adjustable vertically and horizontally, but it pivots. Mars U.S. Pat. No. 5,062,676 (1991), which states that it is useful for those with back injuries, teaches a chair with many adjustments. Last, Foster U.S. Pat. No. 5,110,121 (1992) shows a chair with a back rest supported by an adjustable arm.

SUMMARY OF THE INVENTION

One object of the present invention is to disclose and provide a chair having the back of the chair vertically and horizontally adjustable relative to the seating surface. Arms that attach to the rear of the chair attach to each other through pivots. When the pivots are unlocked, the chair back can move vertically or horizontally. Once the back is positioned properly, the pivots can be locked to secure the back's position. An adjustable tray extends on articulated arms forward of the seal. The tray is similarly adjustable up and down. The edge of the tray nearest the seat back has a wide member that helps hold a person in the correct position in the chair. The chair also has a vertically adjustable seat portion and an adjustable foot rest portion.

BRIEF DESCRIPTION OF THE DRAWINGS

FIG. 7 is a perspective view of the connection between the chair's tray and its support arm. The parts are separated.

FIG. 8 is a view similar to FIG. 7, but the tray and support arm are connected.

FIGS. 9 and 10 are plan views of the connection between the chair's tray and its support arm. The parts are separated in FIG. 9 and connected in FIG. 10.

FIG. 11 is a sectional view of the tray/support arm connection taken through plane 11—11 in FIG. 10.

FIGS. 12 and 13 elevations showing alternate locking members.

DETAILED DESCRIPTION OF THE PREFERRED EMBODIMENT

Figure 1:
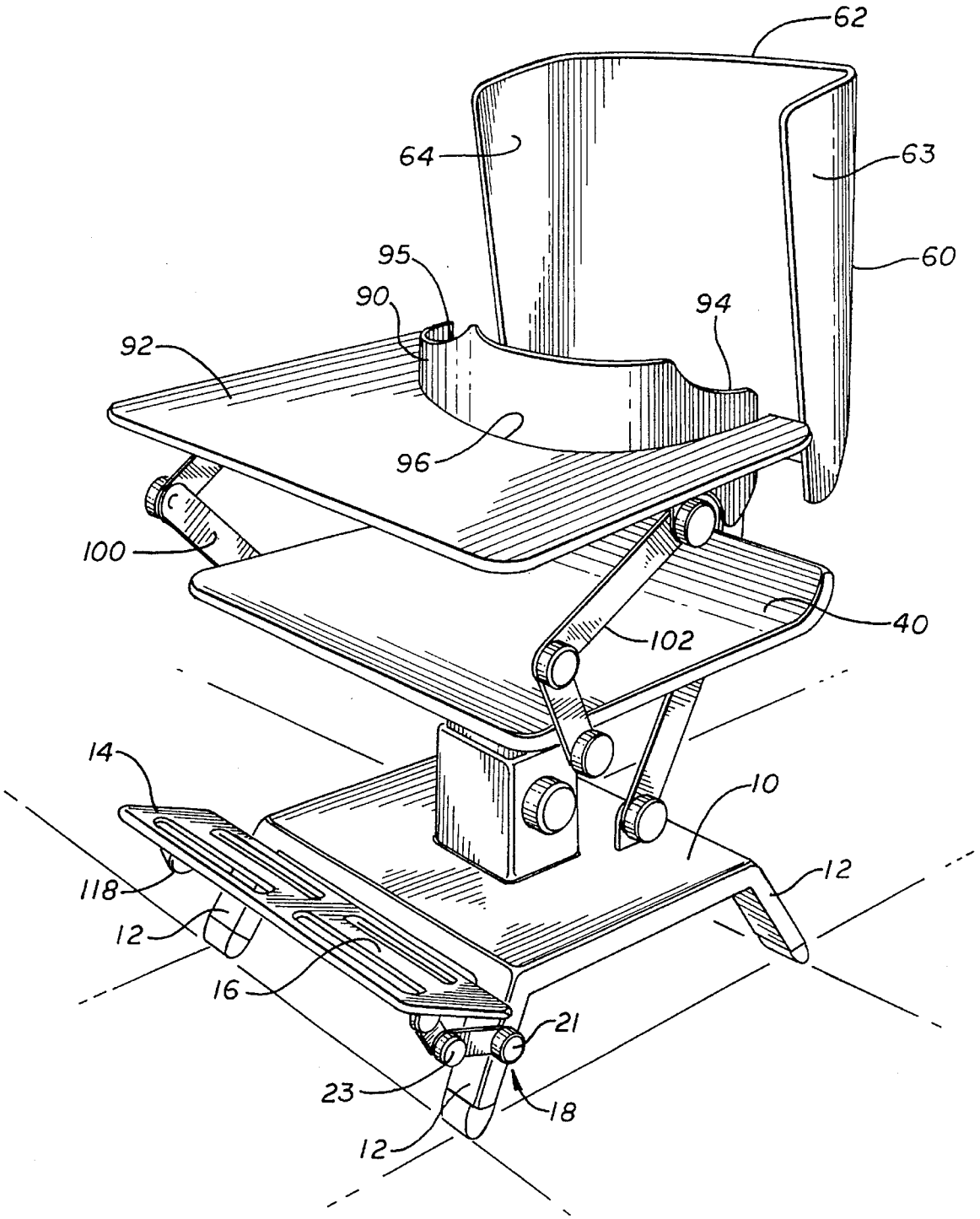
FIG. 1 is a perspective view of the chair of the present invention.
Figure 3:
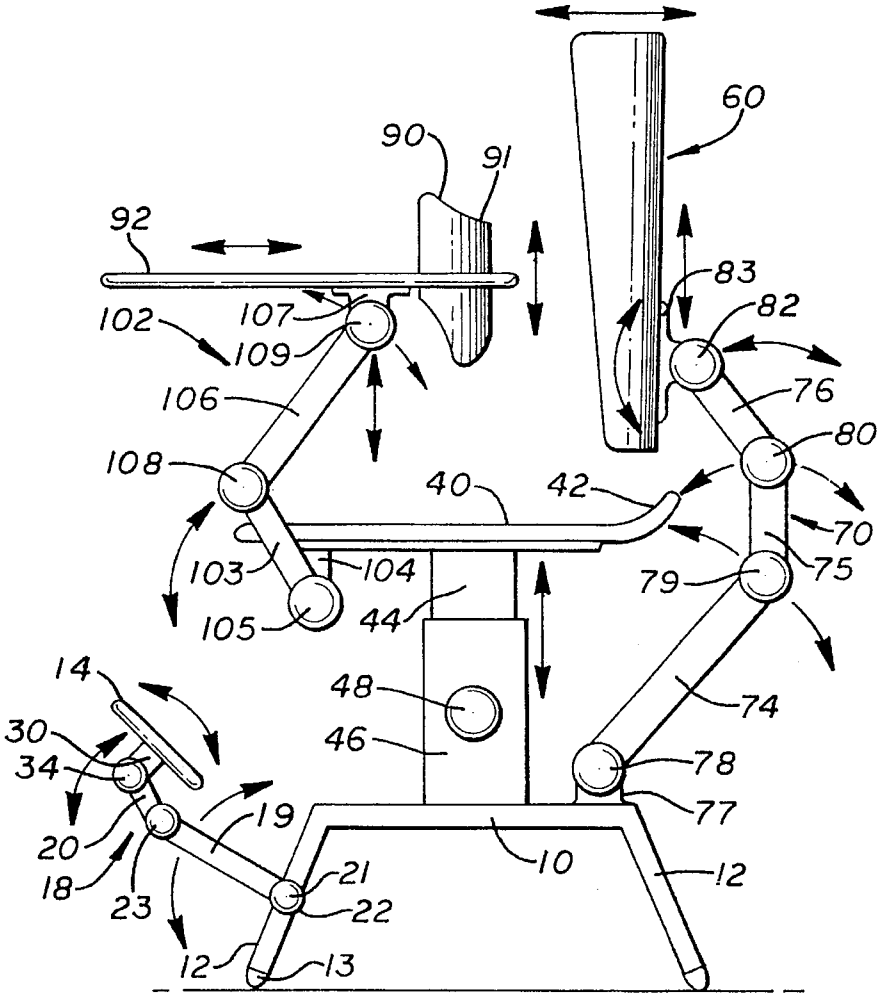
FIG. 3 is a side elevation of the chair of the present invention.
Figure 2:
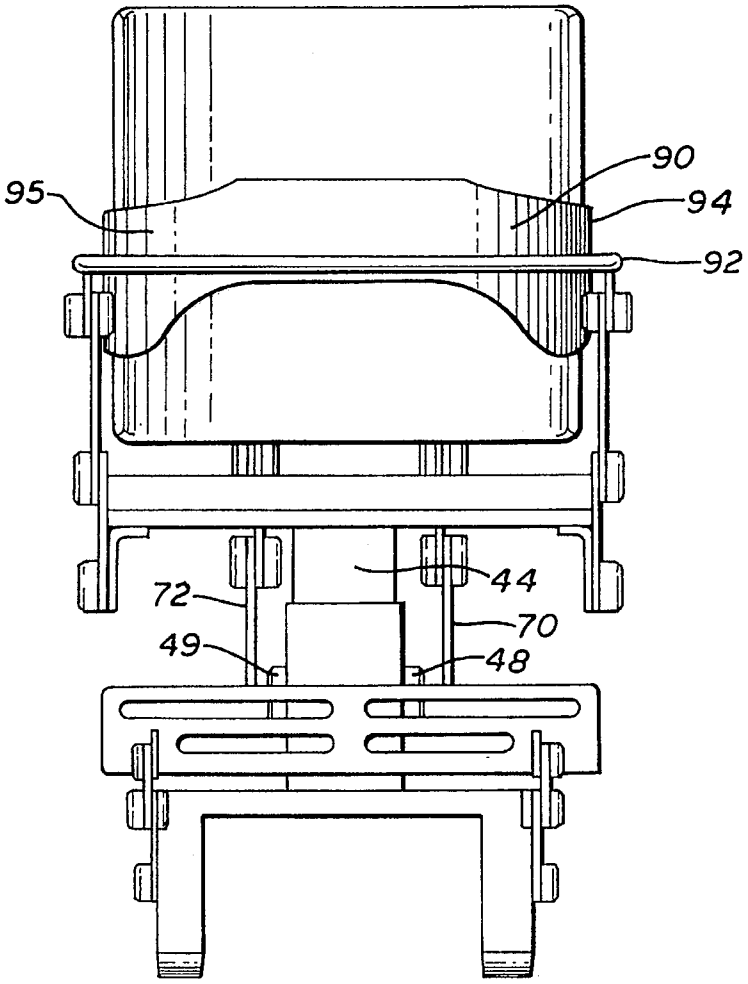
FIG. 2 is a front elevation of the chair of the present invention.

FIGS. 1, 2 and 3 show the general configuration of the chair of the present invention's exemplary embodiment. The chair comprises a base 10 and a seating surface 40 positioned relative to the base. In the exemplary embodiment, the base 10 is formed of steel, stainless steel or aluminum. If steel is used, one should paint the parts or otherwise treat them for corrosion resistance. Metal is preferred because of its strength, but other materials such as wood or plastic may also be acceptable.

The base has four legs 12. In the exemplary embodiment, base 10 is a stamping or casting, and the legs are integral parts of the base. Alternatively, separate legs can attach to the base. One may attach a robber or plastic pad 13 to the end of each leg 12 to protect the floor from the metal legs. Furthermore, casters on two or on all four legs may replace the pads 13 for ease of moving the chair.

The base 10 also has an attached, adjustable footrest 14. The footrest may be padded, but the exemplary embodiment's footrest is a metal plate without a pad and with elongated holes 16. Articulated arms 18 and 118 attach the footrest to the front legs 12 of the base 10. As best seen in FIG. 3, articulated arm 18 comprises a lower arm 19 and a shorter, upper arm 20. The threaded shaft (not shown but see FIGS. 12 and 13 for analogous structure) of a headed bolt 21 attaches the lower arm to leg 12. That is, the bolt passes through a circular bore at one end of the arm, through a corresponding bore in the leg and into a nut. Alternatively, the bore in leg 12 could be threaded. The head 22 on bolt 21 has a sufficient diameter for hand tightening. Tightening bolt 21 pinches arm 19 against leg 12 to fix its orientation. Knurling the head's outer surface eases gripping. One also can provide a large diameter and ridged plastic handle over a rectangular bolt or nut. Although bolt 21 could have a hex end for engagement by a tool, the arrangement in the exemplary embodiment permits adjustments without tools.

Another bolt 23 attaches the upper and lower arms 19 and 20 together (FIGS. 1, 2 and 3). FIG. 12 shows the interaction of bolt 23, nut 24 and arm 19 and 20. FIG. 12 also show the connection of other arms on the chair. Bolt 23 passes through bores 26 and 27 and is threaded into bolt 24. Tightening bolt 23 squeezes arms 19 and 20 together, sandwiching them between the heads of the nut and bolt. If the nut and bolt are sufficiently tight, the arms will lock in their position. The region on the arms near the nut and bolt may have radial teeth to help secure the parts against sliding.

Finally, footrest 14 has a depending plate 30 that attaches to upper arm 20. As FIG. 13 illustrates, plate 30 has a threaded bolt 31 welded to the plate. The threaded bolt passes through bore 32 in upper arm 20 and into nut 34. Tightening nut 34 pulls plate 30 toward it and against arm 20. The footrest locks in position if the bolt is tightened sufficiently.

As FIG. 3 shows, arm 19 pivots about an axis at bolt 21, which mainly raises or lowers the outside end of the arm. Pivoting arm 20 about arm 19 raises and lowers the outside end of arm 20 and sets the horizontal position. The pivoting effect of arm 20 varies with the orientation of arm 19. Finally, one can orient footrest 14 relative to the outside end of arm 20. When the footrest is properly position and angled, the bolts and nuts 21, 23 and 34 are tightened to lock the footrest in its desired position.

Seat 40 generally is flat in the exemplary embodiment with a curved rear lip 42 (FIGS. 1 and 3). The lip supports the buttocks of the user. The surface of seat 40 could be shaped to conform to the user. The drawings do not show padding, but it normally would be provided. Suitable fasteners such as snaps or Velcro® fasteners would secure the padding to the seat.

Seat 40 adjusts vertically relative to the base 10. In the exemplary embodiment, a square or rectangular post 44 (FIGS. 2 and 3) is welded to the bottom of seat 40. The post telescopes into housing 46, which is welded to the top of base 10. As post 44 moves into or out of housing 46, seat 40 adjusts vertically.

The invention holds the vertical position of the seat on the base in several alternate ways. In one, post 44 has holes spaced vertically on the sides of the post. As the post moves vertically in the housing, the holes become aligned with holes in the housing. A long nut 48 extends through the housing's holes and one pair of the post's holes. A nut 49 could lock the bolt (FIG. 2). Alternatively, spring loaded pins could extend through the sides of housing 46. The springs force the pins into holes on the post. This latter arrangement, which is commonly used for exercise equipment, allows rapid adjustment of the seat relative to the base.

The post and housing are square or rectangular for ease of manufacturing. By making them rectangular or square, moreover, the seat and base will not twist about each other.

A chair back is positioned above the seating surface. In the exemplary embodiment, sheet metal or plastic chair back 60 extends above the seating surface as FIGS. 1–6 show. The chair back may be padded, but the drawings show no padding. The chair back 60 has a planar or slightly curved center section 62. The sides of the center section curve into side walls 63 and 64. Persons with spinal chord injuries often cannot sit up straight, so the side walls help hold persons upright.

An articulating arm extending between the chair back and the base positions the chair back. In the exemplary embodiment, two articulating arms 70 and 72 (FIG. 2) connect the chair back. Each articulated arm has at least two and preferably three arms, and articulating arm 70 in FIG. 3 has three such arms 74, 75 and 76. (Only articulating arm 70 is described because FIG. 3 hides articulating arm 72.) Using three arms allows more possible positions and orientations for chair back 60. The articulating arms also could attach to the seat 40 rather than to the base 10. The exemplary embodiment uses an attachment to the base for a greater degree of chair back positions.

Bottom arm 74 connects to a flange 77 that extends upward from base 10 (FIG. 3). The threaded shaft on flange 77 (not shown) passes through a circular bore at the bottom of arm 74. A headed nut 78 attaches threads onto the shaft. (See FIG. 13 for the same structure on similar parts.) Alternatively, the flange also could have a bore and use a headed nut and bolt similar to FIG. 12.

Another bolt 79 attaches bottom arm 74 to intermediate arm 75, and bolt 80 attaches the intermediate arm to the top arm 76. See FIG. 12 for the corresponding structure. Finally, headed nut 82 attaches the top arm to a flange 83 on the chair back.

As FIG. 3 shows, by properly orienting the three arms 74, 75 and 76 and by changing the angle of chair back 60 about top arm 76 (and adjusting corresponding arms on articulating arm 72), the chair back can move substantially vertically or horizontally and can pivot. See the arrows in FIG. 3. This movement allows the chair back to accommodate many different sized persons or to change for the same person. Also, one may angle the chair back if the person is watching television but position it more upright and forward for meals.

The chair of the present invention also includes a front support and a front support articulating arm extending between the seating surface and the front support for positioning the front support. In one exemplary embodiment, the front support 90 has a support section 91, which is attached to a tray 92 (FIGS. 1–3). The front support is curved to conform to persons' front torsos. The sides 94 and 95 of the front support section curve rearward from the center to support the person's torso. The sides also cooperate with the sides 63 and 64 of the chair back for the torso's lateral support.

Front support 90 may be metal or plastic. Its curvature conforms with the curvature of a front cutout 96 of tray 92. The inside of the front support may be padded. The tray also may be metal or plastic. The tray and front support may form a single, integral member, or they may be separate and joined.

Articulating arms 100 and 102 attach the tray/front support to the seat 40. As FIG. 3 shows, lower arm 103 of articulating arm 102 pivots about flange 104. The flange depends from seat 40. Though articulating arms could attach to base 10, attaching the arms to the seat is preferred as they are less likely to interfere with access to the chair. Upper arm 106 pivots about lower arm 103 and extends to flange 107 (FIG. 3). That flange attaches to the tray as discussed below. Bolt or nut 108 can lock arms 103 and 106 in a desired orientation, and bolt or nut 109 can lock arm 106 to flange 107. Thus, the tray/front support can be positioned up or down or pivoted relative to the person in the chair.

The articulating arms' attachment to the tray/front support can be permanent (FIGS. 1–3) or releasible (FIGS. 7–11). In the releasible version, flange 112 has a vertical section 113 and a horizontal section 114. The vertical section attaches to arm 106 as previously discussed. The threaded shaft 116 of headed bolt 115 screws into the horizontal section 114 (FIG. 11).

Tray 92 has a keyhole shaped opening 120. That opening has a narrow portion 121, which is slightly wider than the diameter of threaded shaft 116. Wider portion 122 of opening 120 is slightly larger than head 117 of bolt 115. For assembly, the wider portion is placed over head 117 until the bottom of the tray seats on the top of the flange and the head extends above the tray. The tray is then slid rearward causing shaft 116 to slide along the narrow portion 121. The narrow portion prevents the head from passing through the opening and locks the tray to the flange. For further locking, bolt 115 can be turned to push down, against the tray.

Figure 4:
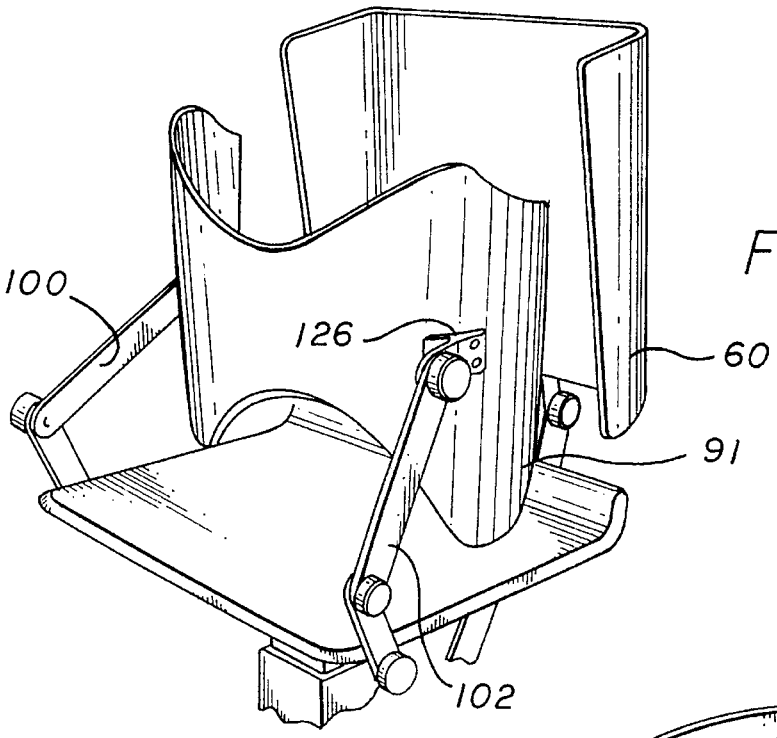
FIG. 4 is a perspective view of part of the chair showing the front support.

FIG. 4 shows an alternate embodiment with no tray and with a larger front support 91. Articulated arms 100 and 102 attach to flanges 126 (FIG. 4 only shows one flange).

Figure 5:
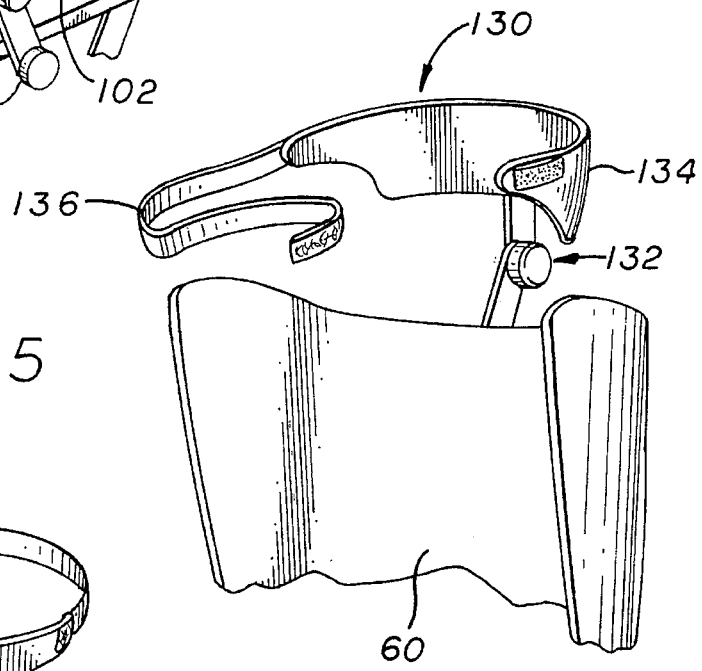
FIG. 5 is a front perspective view showing an optional head support.
Figure 6:
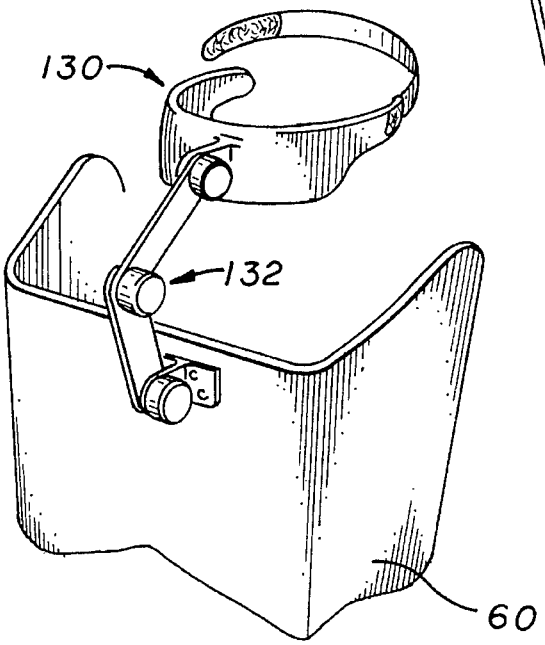
FIG. 6 is a rear perspective view of the head support.

The chair of the present invention also may have a head support. In an exemplary embodiment, an articulating arm 132 attaches a head support 130 to the chair back 60 (FIGS. 5 and 6). The head support has a rear rim 134 for supporting the back of the person's head. A releasible strap 136 attaches to one side of the rim and fastens with snaps or Velcro® to the other side of the rim.

As numerous modifications and alternate embodiments will occur to those skilled in the art, it is intended that the invention is limited only in terms of the appended claims.

I claim:

1. A chair primarily for use by persons with spinal chord injuries comprising:

a. a base and a seating surface positioned relative to the base;

b. a chair back;

c. a chair back articulating arm extending between the chair back and the base, the chair back articulating arm positioning the chair back above the seating surface, the chair back articulating arm having at least three sections attached together end to end, a lock at the attached ends of at least two of the sections, each lock securing the sections together and alternatively allowing pivoting of the sections relative to each other or locking the sections against such pivoting;

d. a front support, the front support comprising a support section, the support section having a substantially vertical component extending laterally across, in front of and at a spaced distance from the chair back; and e. a front support articulating arm extending between the seating surface and the front support, the front support articulating arm having at least three sections attached together end to end, a lock at the attached ends of at least two of the sections, each lock securing the sections together and alternatively allowing pivoting of the sections relative to each other or locking the sections against such pivoting.

2. The chair of claim 1 further comprising a post extending below the seating surface, a housing extending above the base and receiving the post at different depths within the housing.

3. The chair of claim 1 wherein the chair back has sides curved in a direction of the seating surface.

4. The chair of claim 1 further comprising a foot rest and a foot rest positioning memos connecting the foot rest to the base.

5. The chair of claim 4 wherein the footrest positioning means has a plurality of sections attached together end to end, a lock at the attached ends of at least two of the sections, each lock securing the sections together and alternatively allowing pivoting of the sections relative to each other or locking the sections against such pivoting.

6. The chair of claim 1 further comprising a head support and a head support positioning means connecting the head support to the chair back.

7. The chair of claim 6 wherein the head support means has a plurality of sections attached together end to end, a lock at the attached ends at at least two of the sections, each lock securing the sections together and alternatively allowing pivoting of the sections relative to each other or locking the sections against such pivoting.

8. The chair of claim 1 further comprising a second chair back articulating arm spaced on the base and the chair back from the first-mentioned chair back articulating arm, the second chair back articulating arm extending between the chair back and the base, the second chair back articulating arm having at least three sections attached together end to end, and a lock at the attached ends of at least two of the sections.

9. The chair of claim 8 further comprising a second front support articulating arm spaced from the first mentioned front support articulating arm, the second front support articulating arm extending between the seating surface and the front support, the second front support articulating arm having at least three sections attached together end to end, and a lock at the attached ends of at least two of the sections.

10. The chair of claim 1 wherein the front support further comprises a tray attached to the support section and extending in a direction away from the chair back.

11. The chair of claim 10 wherein the support section has a center section and sides, the support section being curved such that the sides are closer to the chair back than the center section.

12. The chair of claim 10 wherein the front support is releasibly attached to the front support articulating arm.

13. A chair primarily for use by persons with spinal cord injuries comprising:

a base;

a seating surface connected to the base;

a chair back, the chair back having sides curved in a direction of the seating surface;

a chair back articulating arm connecting the chair back to the base, the chair back articulating arm positioning the chair back above the seating surface, the chair back articulating arm having a plurality of sections attached together end to end, a lock at one end of at least two of the sections securing the sections together and alternatively allowing pivoting of the sections relative to each other or locking the sections against such pivoting;

a front support comprising a support section, the support section having a substantially vertical component extending laterally across, in front of and at a spaced distance from the chair back, the support section comprising a center section and sides, the support section being curved such that the sides are closer to the chair back than to the center section; and a front support articulating arm connecting the seating surface to the front support, the front support articulating arm having a plurality of sections attached together end to end, a lock at one end of at least two of the sections securing the sections together and alternatively allowing pivoting of the sections relative to each other or locking the sections against such pivoting;

whereby the curved support section of the front support and the curved sides of the chair back combine to effect an all around support for persons using the chair.

14. The chair of claim 13 wherein the front support further comprises a tray attached to the support section and extending in a direction away from the chair back.

15. The chair of claim 13 wherein the front support is releasibly attached to the front support articulating arm.

16. The chair of claim 13 further comprising a post extending below the seating surface, a housing extending above the base and receiving the post at different depths within the housing.

17. The chair of claim 13 further comprising a foot rest and a foot rest positioning means connecting the foot rest to the base.

18. The chair of claim 17 wherein the foot rest positioning means has a plurality of sections attached together end to end, a lock at the intersections of at least two of the sections securing the sections together and alternatively allowing pivoting of the sections relative to each other or locking the sections against such pivoting.

19. The chair of claim 13 further comprising a head support and a head support positioning means connecting the head support to the chair back.

20. The chair of claim 19 wherein the head support positioning means has a plurality of sections attached together end to end, a lock at the intersections of at least two of the sections securing the sections together and alternatively allowing pivoting of the sections relative to each other or locking the sections against such pivoting.

* * * * *